US005203482A

United States Patent [19]

Puff

[11] Patent Number: 5,203,482

[45] Date of Patent: Apr. 20, 1993

[54] SHOULDER STRAP

[76] Inventor: Rosanne Puff, P.O. Box 2352, Santa Barbara, Calif. 93120

[21] Appl. No.: 793,785

[22] Filed: Nov. 18, 1991

[51] Int. Cl.[5] ..... A45F 3/14

[52] U.S. Cl. ..... 224/257; 224/151; 224/264; 224/202

[58] Field of Search ..... 224/257, 258, 264, 150, 224/202, 208, 151, 205; 150/107, 108

[56] References Cited

U.S. PATENT DOCUMENTS

| | | | |
|---|---|---|---|
| 414,916 | 11/1889 | Nelson | 224/264 |
| 2,056,925 | 10/1936 | Kimbrough | 224/264 |
| 3,057,526 | 10/1962 | Jaquith | 224/258 |
| 4,389,005 | 7/1983 | Cable et al. | 224/258 X |
| 4,401,246 | 8/1983 | Dickinson et al. | 224/258 X |
| 4,550,869 | 11/1985 | Johnson | 224/257 X |
| 4,827,578 | 5/1989 | Heckerman et al. | 224/257 X |
| 4,867,359 | 9/1989 | Donovan | 224/264 X |
| 4,879,768 | 11/1989 | McClees et al. | 224/264 X |
| 4,942,995 | 7/1990 | Myers | 224/258 |
| 4,976,388 | 12/1990 | Coontz | 224/264 |
| 4,978,044 | 12/1990 | Silver | 224/257 X |

*Primary Examiner*—Henry J. Recla
*Assistant Examiner*—Glen T. Barrett

[57] ABSTRACT

An adjustable carrying strap for luggage or similar moderately heavy loads comprises a middle section of thin pliable material that can spread over and around the shoulder, thus to conform to the shape of the shoulder, distribute the load, and securely position the strap. The middle section of pliable material is folded and attached to the end sections, comprising conventional adjustable strap assemblies, so that when pulled taught, the middle section of the strap folds itself into a width comparable to that of the end section strap material, thus to be used as a simple shoulder strap.

1 Claim, 5 Drawing Sheets

SHOULDER STRAP

BACKGROUND OF THE INVENTION

1. Field of the Invention

The present invention relates generally to adjustable carrying straps for use as shoulder straps for carrying luggage, camera bags and the like; especially to devices incorperated in the strap to distribute, cushion, or otherwise make more comfortable the load on the shoulder and back of the person carrying the item.

2. Prior Art

Carrying straps for use by individuals to transport moderately heavy loads such as luggage, garment bags, sample cases, golf clubs, tool kits, camera equipment, surf boards, and other such items have often incorporated or had attached to them devices intended to alleviate the painfull tendency of these straps to dig into the shoulde and neck. Some commercial luggage straps have nothing more than a small piece of felt sewn onto the strap; some actually make matters worse by attaching a stiff rubber pad with hard edges. However, the soft device used by Silver (U.S. Pat. No. 4,978,044) is more typical of the many wrap around, slip on, tie on, or otherwise attach on strap pads thought up over the years. The earliest such patented attachment I found was U.S. Pat. No. 414,916 approved in 1889. There have been many others submitted and approved over the years; the problem of painfull shoulder straps seems to endure.

More elaborate and recently patented schemes for alleviating the shoulder strap problem are typified by:

| | | |
|---|---|---|
| the shock absorber | Coontz | 4,976,388 |
| the wide, long pad | Dickinson | 4,401,246 |
| the extensive internal pad | Johnson | 4,550,869 |

While these designs demonstrate the diversity of approaches that can be taken to the problem, and do address it by softening and distributing the load, none of them is of particularly simple manufacture nor provides a definitive solution. The problem of designing an effective, easy to use, convenient to store, luggage carrying type shoulder strap is still one that is open to new ideas.

SUMMARY OF THE INVENTION

I have designed a new solution that is at once simpler and more effective than shoulder strap devices produced heretofore. The present invention incorporates a load bearing middle section made of strong, soft, thin, and pliable material that unfolds to spread both over and around the shoulder, especially when the the strap is deployed diagonally across the body to the attached load. This feature substantially increases the surface area of the strap thus to distribute the load on and around the shoulder.

Another feature of the present invention is that in conforming to the shape of the shoulder, the horizontal component of the load pulls into the upper arm portion of the shoulder, so the strap does not slide across the top of the shoulder nor does it ride up on the neck or collar bone.

A further feature of the present invention is that both ends of the strap are adjustable for length so the attached load can be postioned to accomodate its shape and/or let the user position the load more to the front of the body or further back on the hip as comfort or circumstance require.

An additional feature of the present invention is that the middle section of the strap is folded and attached to the end sections in such a way that when pulled taught, the middle section naturally folds itself to assume a width comparable to that of the end section strap material and thus can be worn as a simple strap either on the same shoulder or across the body.

Another feature of the present invention is that the middle section of the strap is well suited to incorporate decorative designs, logo identifications, or promotional artwork.

DETAILED DESCRIPTION

Figure 1:
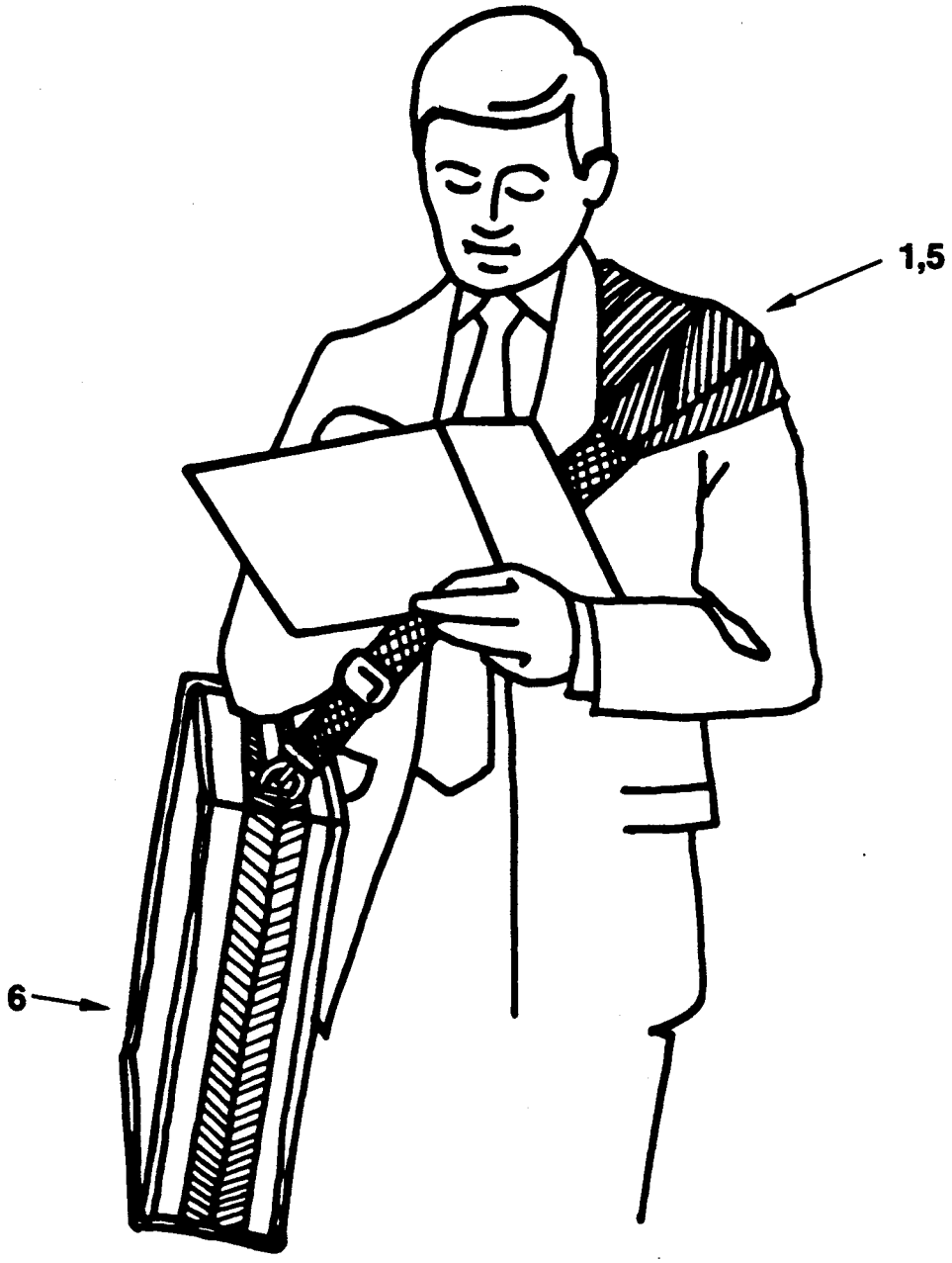
FIG. 1 is a perspective view of the shoulder strap as it would be used to carry an item of luggage.
Figure 2:
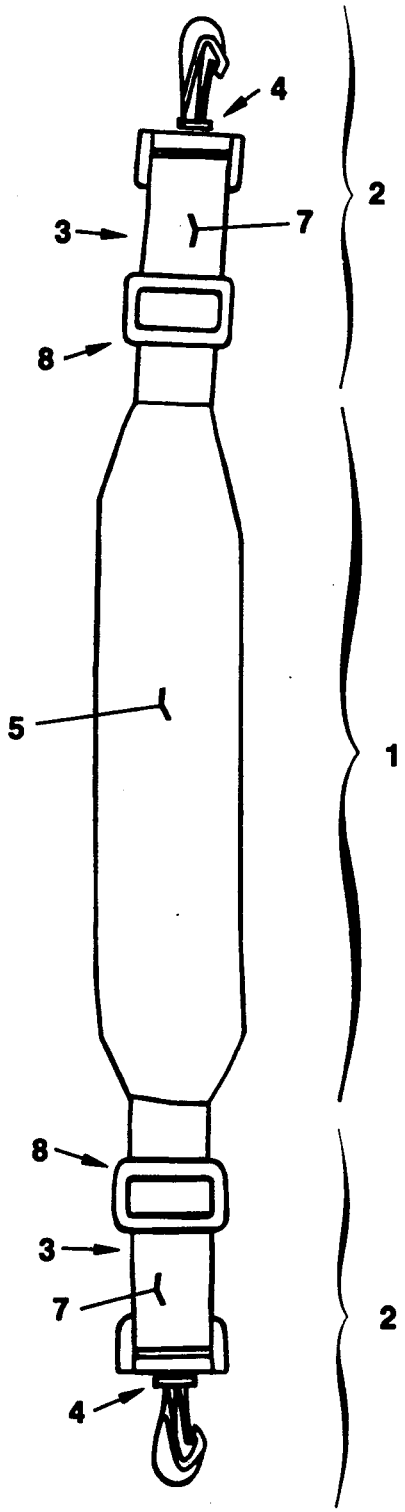
FIG. 2 shows a top view of the strap as it would appear laid out flat on a table.
Figure 3:
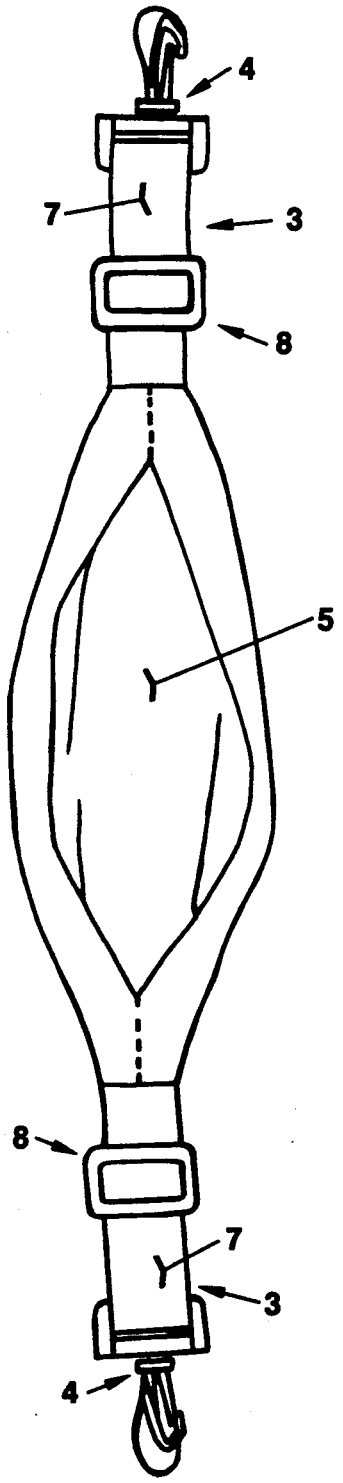
FIG. 3 shows an underside view of the strap with the middle section unfolded partially open.
Figure 4:
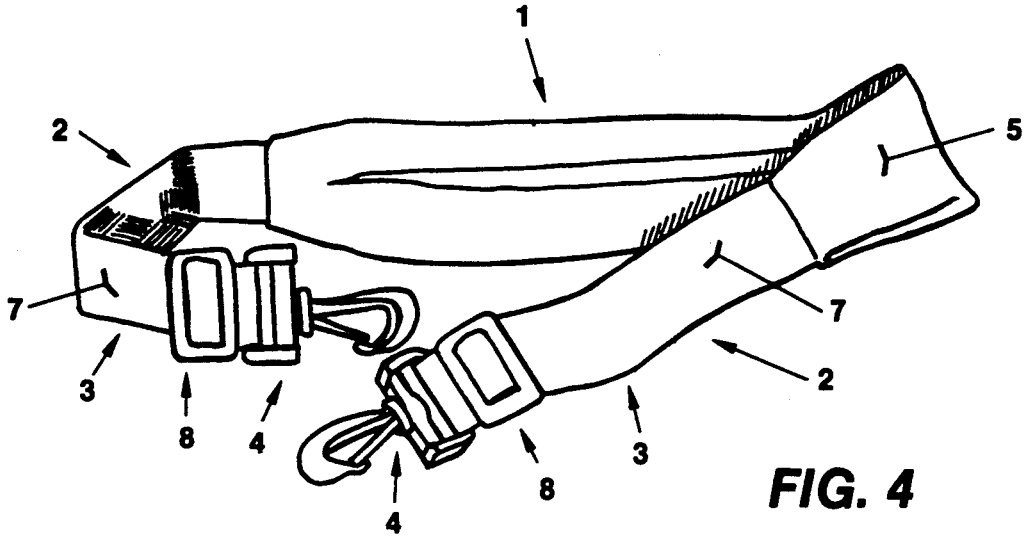
FIG. 4 shows the strap just flopped down showing its flexibility and typical load attaching fixtures.
Figure 5:
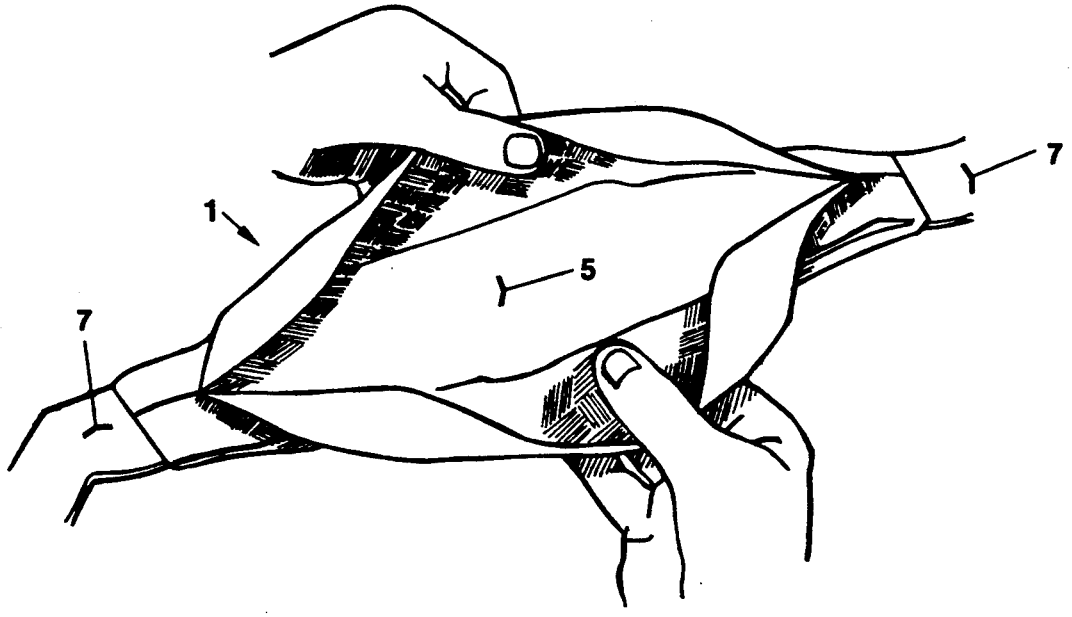
FIG. 5 shows an underview of the middle section of the strap with the pliable material held open to show more detail of how it unfolds to fit over the shoulder.

A complete strap assembly shown in FIG. 2 3, and 4 includes a middle section 1 of pliable material 5 that is folded and attached to two end sections 2 that are themselves simple, length adjustable, straps 3 with conventional snap fasteners 4 on their ends. The middle section of the strap can be unfolded to form a wider, pocket shaped section as shown in FIG. 5, which when worn as shown in FIG. 1 rides over and around the shoulder cap to cup the shoulder, thus supporting the load of the luggage 6, or other such item, to which the strap has been attached by the fasteners 4. Not actually depicted in FIG. 1, but implicit in the drawing and symmetrical to that portion of the strap depicted, is the other end of the strap positioned diagonally across the back of the traveler and attached to the other end of the luggage item.

The end sections of the strap 2 are made of conventional strap material 7 and include the conventional strap length adjustment means 8, comprising a rectangular slide formed as a rectangular frame member having a tongue extending across the middle of the frame member, that permits length adjustment by nearly a factor of two on these sections of the strap. The fasteners 4 used to attach the strap to an item to be carried as depicted in this preferred embodiment of the invention are swiveled, snap hooks of high impact plastic; these are merely an example of the many different devices that can be employed to secure the strap to an item to be carried.

Figure 7:
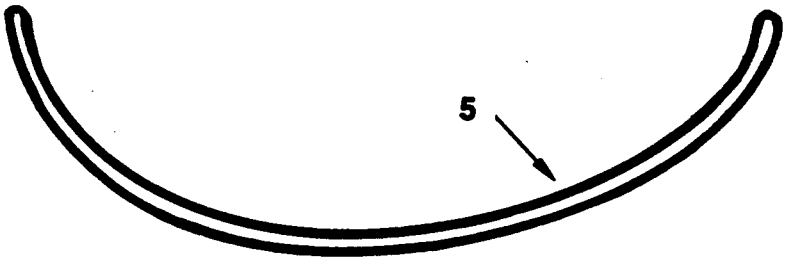
FIG. 7 is a cross section view of the middle section of the strap, showing the kind of shape it can assume at its center when pulled open as shown in FIG. 5.

The middle section of the shoulder strap, which is the significant design feature of the present invention, employs a piece of strong, soft, thin, and pliable material 5, approximately six times the width of the end section strap material, attached to the two end sections using the fold technique and method herein disclosed. As a result of this attachment method, the middle section of the strap 1, when pulled taught folds itself in such a way that it assumes a width comparable to the end strap material as shown in FIG. 2, and when pulled open forms an elongated cup or soft trough shape as shown in FIG. 5 and FIG. 7.

Figure 6:
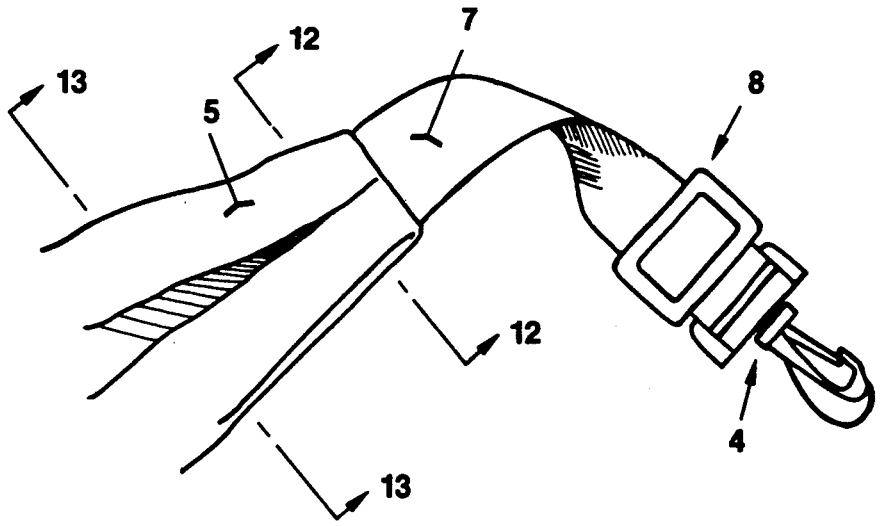
FIG. 6 shows a rightside out view of that part of the strap where the middle section is attached to an end section; it provides cross section views of the pliable middle material to show how its folded and the shapes it assumes.
Figure 12:
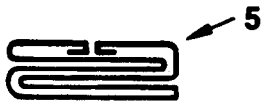
FIG. 12 shows a cross section view of the pliable material of the center section of the strap near its point of attachment to the end section strap material. It depicts the folded form of the pliable material at the point of attachment, which form it maintains for approximately one inch beyond the point of attachment.
Figure 13:
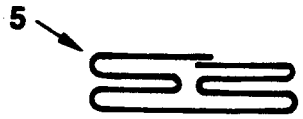
FIG. 13 shows a cross section view of the pliable material of the center section of the strap towards the center of the strap, away from the points of attachment. It depicts the pleated, folded form that the pliable material takes on when it is pulled taut, which form it maintains for the full length of the center section except at the very ends near the points of attachment.

FIG. 6 shows the underside view of the attachment area depicted rightside out as would be seen in normal use. Section view FIG. 12 shows how the middle section 1 of pliable material 5 is folded at the point of attachment to the end section 2 strap material 7. Section view FIG. 13 shows the fold that the pliable material 5 assumes a few inches away from the point of attachment, and that the middle section 1 of the strap assumes along its full length when pulled taught. FIG. 7 shows in cross section an underside up view of how the middle section 1 of pliable material 5 is opened up, so that it can deployed to distribute the load over and around the shoulder cap.

Figure 8:
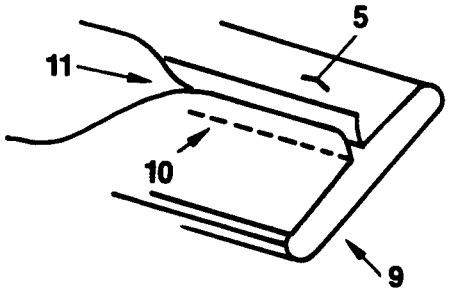
FIGS. 8, 9, 10, and 11 show inside out views of that part of the strap where the middle section is attached to an end section, disclosing the steps of manufacture that produce the unique folding of the pliable material of the middle section where it is attached to the end section material of the strap.
Figure 9:
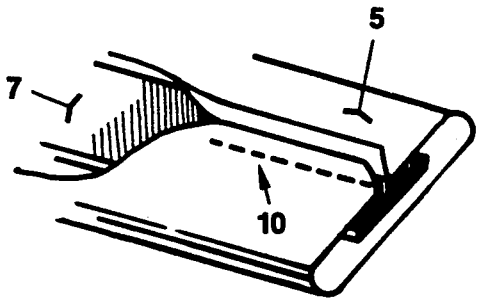
Figure 10:
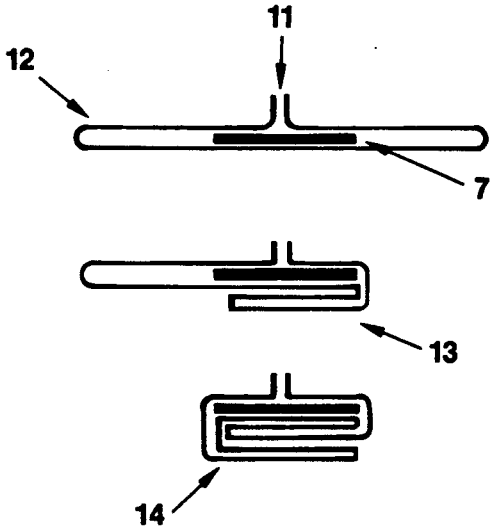
Figure 11:
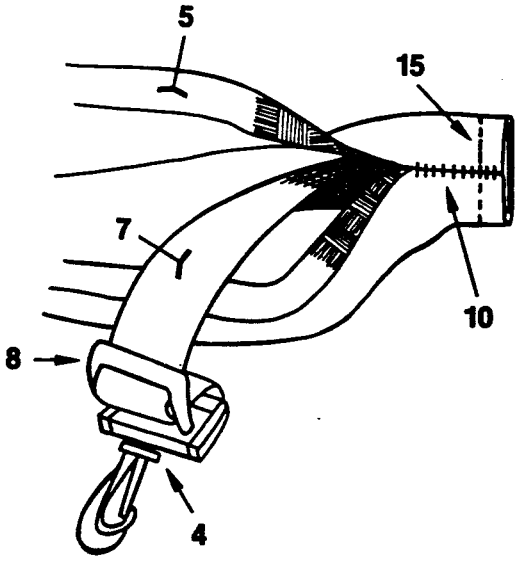

FIGS. 8, 9, 10, and 11 show the specific method and steps of manufacture used to attach the middle section of pliable material to the end section strap material. All views in FIGS. 8, 9, 10, and 11 depict the attachment area inside out, with the underside of the strap facing up. FIG.8 shows the end of the pliable material brought around and attached to itself to form a tube 9 for a length 10 slightly more than the width of the end section strap material. This line of attachment 10 has the additional effect of defining the centerline of the underside 11 of the entire strap assembly. The end section strap material 7 is placed in the tube, brought flush to the end, as shown in FIG. 9, and centered along the line of the tube forming seam 10 as shown in the end view of FIG. 10. The flattened tube of pliable material 12 is folded down and back across the end section strap 7, first one side 13, then the other side 14. The pliable material of the middle section is thus wrapped around and held flat to the end section strap material; these are then firmly attached to each other through all the layers of material 15 to form the completed inside out attachment of the two sections as shown in FIG.11. In the case of the depicted embodiment all these layers of material are sewn together 15, though other methods of attachment are conceivable Thus it has been shown that the preferred embodiment of the invention empolying the described means of attaching a wider pliable middle section to end sections of conventional strap material produces a unique carrying strap for luggage and other such items. When deployed across the body to the attached load, the middle section can be spread over and around the shoulder thus distributing the weight and firmly positioning the strap on the body. In other situations, not warranting full use of the expandable middle section, the strap pulls into a near uniform narrow width, and in this fashion can be used as a conventional strap either on the same shoulder as the load or across the body.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description but rather by the claims appended hereto.

I claim:

1. A shoulder strap assembly adapted for attachment to an object for carrying a load, said shoulder strap assembly comprising:

first and second end sections of narrow strap material, wherein each of said end sections having a length, a width, a first end and a second end whereby each of said first ends of said end sections includes a fastener assembly adapted for securing said end section to said object, and each end section having an adjustment device positioned intermediate said first and second ends for adjusting the length of said end section; and an elongated middle section of thin pliable material having a longitudinal axis, an intermediate section and a pair of free ends wherein one of said free ends is secured to said second end of said first end section and the other of said free ends is secured to said second end of said second end section, said middle section having a width such that it is folded along its longitudinal axis to form in cross section an open seamed tube having a plurality of pleats extending along the longitudinal axis, said folded free ends of said middle section being secured to said end sections such that said middle section has a folded width approximately equal to the width of the end sections, said intermediate section having a folded position and an unfolded position such that said end sections and said middle section form a conventional shoulder strap when said intermediate section is in said folded position, said intermediate section can be unfolded to said unfolded position such that said intermediate section expands to the full width of the middle section whereby the intermediate section can be positioned over a shoulder of a user such that said intermediate section is adapted to distribute the load of the object over the entire shoulder of the user, and said middle section being folded such that said free ends can be pulled taut by the user to return the intermediate section from the unfolded position to the folded position.

* * * * *